US005516229A

United States Patent [19]

Atchley et al.

[11] Patent Number: 5,516,229

[45] Date of Patent: May 14, 1996

[54] DRAIN FIELD SYSTEM

[75] Inventors: Frederic P. Atchley; Michael D. Maroschak, both of Apopka, Fla.

[73] Assignee: Plastic Tubing Industries, Inc., Orlando, Fla.; a part interest

[21] Appl. No.: 219,671

[22] Filed: Mar. 23, 1994

[51] Int. Cl.[6] ..... E02B 13/00

[52] U.S. Cl. ..... 405/36; 405/43

[58] Field of Search ..... 405/36, 43, 44, 405/46; 137/255, 561 A; 210/170, 532.2

[56] References Cited

U.S. PATENT DOCUMENTS

| | | | |
|---|---|---|---|
| 2,366,522 | 1/1945 | Gutman | 405/46 |
| 3,060,693 | 10/1962 | Taylor . | |
| 3,403,519 | 10/1968 | Balko . | |
| 3,441,140 | 4/1969 | Thurber . | |
| 3,698,195 | 10/1972 | Chapin | 405/44 |
| 4,019,326 | 4/1977 | Herveling et al. . | |
| 4,188,154 | 2/1980 | Izatt | 405/43 |
| 4,588,325 | 5/1986 | Seefert | 405/46 |
| 4,799,822 | 1/1989 | Wintermantel et al. | 405/46 |
| 4,824,287 | 4/1989 | Tracy | 405/36 |
| 4,904,112 | 2/1990 | McDonald | 405/43 X |
| 4,950,103 | 8/1990 | Justice | 405/43 |
| 5,015,123 | 5/1991 | Houck et al. | 405/45 |
| 5,074,708 | 12/1991 | McCann | 405/43 X |
| 5,087,151 | 2/1992 | DiTullio | 405/43 |

FOREIGN PATENT DOCUMENTS

| | | | |
|---|---|---|---|
| 90422 | 4/1987 | Japan | 405/43 |
| 1069720 | 1/1984 | U.S.S.R. | 405/43 |
| 1442605 | 2/1988 | U.S.S.R. | 405/43 |
| 2040151 | 8/1980 | United Kingdom | 405/43 |

*Primary Examiner*—John A. Ricci

*Attorney, Agent, or Firm*—Allen, Dyer, Doppelt, Franjola & Milbrath

[57] ABSTRACT

A drain field and a drain field assembly for use with a sewage disposal system are provided that do not require the use of aggregate in the form of rock, gravel, shale, or the like. The assembly contains a distribution pipe having a plurality of holes disposed along its bottom half for receiving liquid effluent. Alongside and beneath the distribution pipe are positioned a plurality of void pipes that serve to retain and distribute the effluent received from the distribution pipe. Draped over the top and along the sides of the assembly is a protective sheeting that is impervious to soil and liquid permeable that serves to keep soil from entering the pipes and also to aid in evapotranspiration. The drain field of the present invention contains the assembly positioned within a trench and covered in backfill material.

21 Claims, 7 Drawing Sheets

DRAIN FIELD SYSTEM

BACKGROUND OF THE INVENTION

1. Field of the Invention

The present invention relates to sewage disposal systems and, more particularly, to an improved rockless drain field system using multiple corrugated drain pipes.

2. Description of Related Art

Traditional sewage systems, such as those used for disposing waste from homes that are not connected to sewer lines, typically comprise a concrete, plastic, or steel septic tank into which both solid and liquid waste flow. The tank has one or more compartments through which the sewage flows horizontally and is kept out of contact with the air for a minimum of 24 hours. Spontaneous biological action liquefies much of the organic matter, while fine particles settle to the bottom, where bacteria convert some of the organic matter into methane and carbon dioxide. The solid matter either decomposes or is periodically pumped out of the tank.

The liquid flows out of the septic tank through a perforated pipe surrounded by loose aggregate, usually a bed of rock or gravel. The soil itself then continues the filtering process, and the liquid ultimately returns to the ground water.

The installation of such sewage systems entails digging a trench into which is poured aggregate in the form of rock, crushed stone, or gravel. The perforated pipe is then laid down on the aggregate, and additional aggregate is added to a required depth. The top layer consists of soil cover, preferably planted, to facilitate surface water runoff.

Conventional systems require a considerable amount of skilled labor and expensive materials. The installations must meet stringent state and local codes, and must often take place in difficult terrain. For instance, suitable fill material is often difficult to obtain, since the aggregate must meet size and cleanliness requirements.

An additional problem with currently used systems is that the aggregate material, being of nonuniform sizes, has variable properties with regard to retention and evenness of distribution. The aggregate is capable of sealing off with sewage material, which prevents further filtration at such sealed off sites.

Another problem with conventional systems is that the perforated pipe through which the fluid exits the septic tank is typically buried 2 feet beneath the surface. This depth can both hinder evapotranspiration of liquids into the atmosphere and can also cause backup with as little as 10 inches of rainfall, depending on the soil and water table conditions.

A previous rockless drain field system has been described by Seefert (U.S. Pat. No. 4,588,325). The apparatus disclosed therein comprises a distribution pipe having perforations suspended above an empty trench. The pipe is suspended above the trench bottom within a channel formed by a plurality of mesh-like channel forming members. In overlying relation to these members is a porous length of sheet goods, through which evapotranspiration occurs.

Another rockless drain field system is disclosed by Houck et al. (U.S. Pat. No. 5,015,123). This system provides a preassembled drainage line unit comprising a perforated conduit surrounded by loose aggregate. The aggregate is bounded by a perforated sleeve, through which liquid may pass into the soil.

SUMMARY OF THE INVENTION

It is an object of the present invention to provide a drain field system that does not require the addition of aggregate material.

It is a further object to provide a system that has uniform retention and distribution properties.

It is another object to provide a system that has improved transpiration properties.

It is yet an additional object to provide a system that has improved capacity and flow over conventional systems.

It is a further object to provide a prepackaged system that is less labor intensive than currently used systems.

It is yet another object to provide a system that has increased longevity and is environmentally sound.

It is yet an additional object to provide a system that has fluid retention time as a variable.

The foregoing objects are achieved with the drain field and drain field assembly of the present invention, which form a part of an improved drain field system.

The drain field assembly disclosed herein has a top edge, a bottom edge, and two sides for use with a sewage disposal system. The assembly comprises a generally cylindrical distribution pipe for receiving liquid effluent from the sewage disposal system. The distribution pipe has an inlet at a first end, a second end, a cylindrical axis, a bottom half defined by an imaginary line bisecting the distribution pipe along the cylindrical axis, a wall. The distribution pipe further has a plurality of holes through the wall distributed along the bottom half. In one embodiment the second end is capped.

The assembly also comprises a plurality of generally cylindrical void pipes for receiving effluent from the distribution pipe, retaining the effluent for a time, and distributing the effluent to an area of soil. Each void pipe has a cylindrical axis, a wall, and a plurality of holes through the wall.

A third component is a protective soil-impervious, liquid-permeable sheeting surrounding the top edge and the two sides of the assembly for protecting the holes in the distribution pipe and the void pipes from intrusion by soil.

When the assembly is formed, the distribution pipe is positioned along the top edge of the assembly with its bottom half facing the bottom edge of the assembly. The distribution pipe and the void pipes are situated in a plurality of adjacent rows. The cylindrical axes of the distribution pipe and the void pipes are arranged generally parallel to each other and to the sides of the drain field assembly, and one row of void pipes is disposed along the bottom edge of the assembly.

In one embodiment of the assembly, the holes in the distribution pipe are disposed in two generally straight, generally parallel lines, which are generally parallel to the cylindrical axis. In this embodiment, the holes in the void pipes are disposed in a plurality of generally straight, generally parallel lines, which are generally parallel to the cylindrical axis.

In an exemplary embodiment the plurality of adjacent rows takes the form of three rows. The top edge of the assembly comprises the distribution pipe and two void pipes, one void pipe on either side of the distribution pipe. The center row comprises four void pipes, and the bottom edge of the assembly comprises three void pipes. The rows are disposed in a close-packed arrangement, wherein the cylindrical axes of any three adjacent pipes define an equilateral triangle in a cross section normal to the cylindrical axes.

The drain field of the present invention comprises the drain field assembly as described above situated in a generally rectangular trench with its bottom edge facing downward and covered over with backfill material. In operation, the distribution pipe receives liquid effluent from a sewage disposal system, usually a septic tank, through its inlet at the first end.

The features that characterize the invention, both as to organization and method of operation, together with further objects and advantages thereof, will be better understood from the following description used in conjunction with the accompanying drawing. It is to be expressly understood that the drawing is for the purpose of illustration and description and are not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
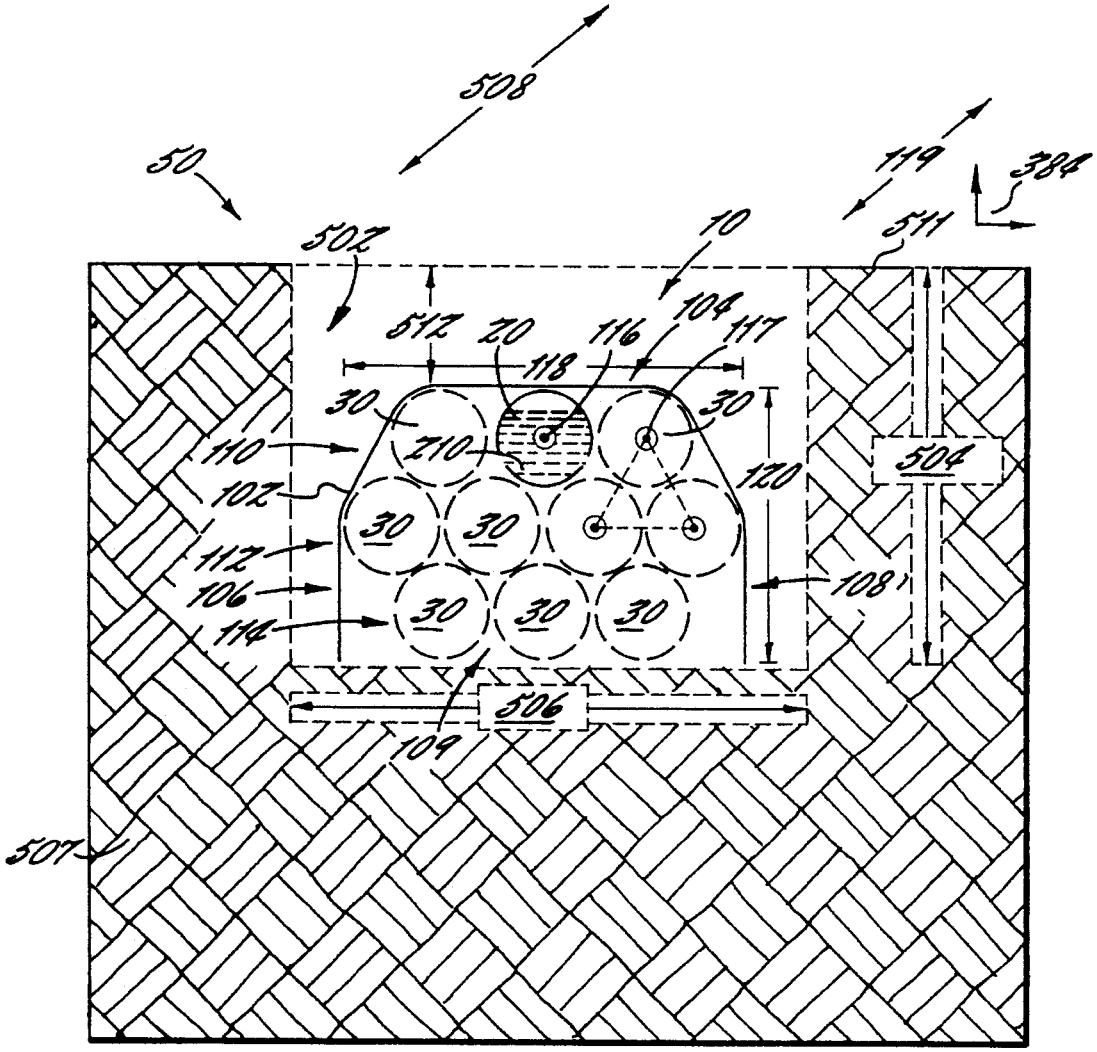
FIG. 1 is a cross-sectional view of the assembly of pipes draped with a cloth cover and situated in a trench.

A description of the preferred embodiments of the present invention will now be presented with reference to FIGS, 1–8, FIG. 1 illustrates a cross-sectional view of an exemplary embodiment of the drain field assembly of the present invention, referred to generally by the reference numeral 10, has a width 118, a length 119, and a height 120. Drain field assembly 10 comprises a plurality of generally cylindrical perforated pipes having a protective sheeting 102 covering its top 104 and both sides 106 and 108 but not its bottom 109. The pipes include one distribution pipe 20 and a plurality of void pipes 30 disposed in a plurality of adjacent rows wherein the cylindrical axes 116 and 117, respectively, of the pipes are generally parallel to each other and to the sides 106 and 108. The distribution pipe 20 is positioned in the top row 110 of the assembly 10.

In general, the assembly functions as follows: Liquid effluent from a sewage disposal system such as a septic tank is channeled into distribution pipe 20. The effluent trickles out of the perforations in distribution pipe 20 into void pipes 30, from which the effluent subsequently trickles into other void pipes 30, after being retained for a time within the void pipes 30, and ultimately into the ground.

Figure 2:
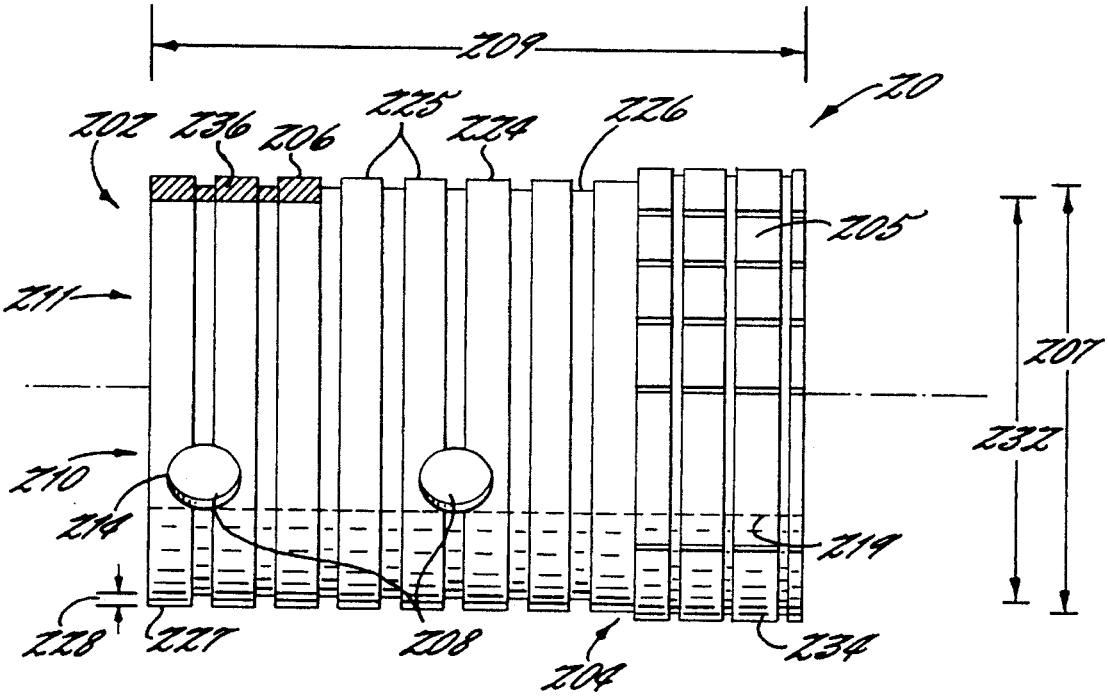
FIG. 2 is a side view of a distribution pipe of the system of the present invention having two rows of holes.
Figure 3:
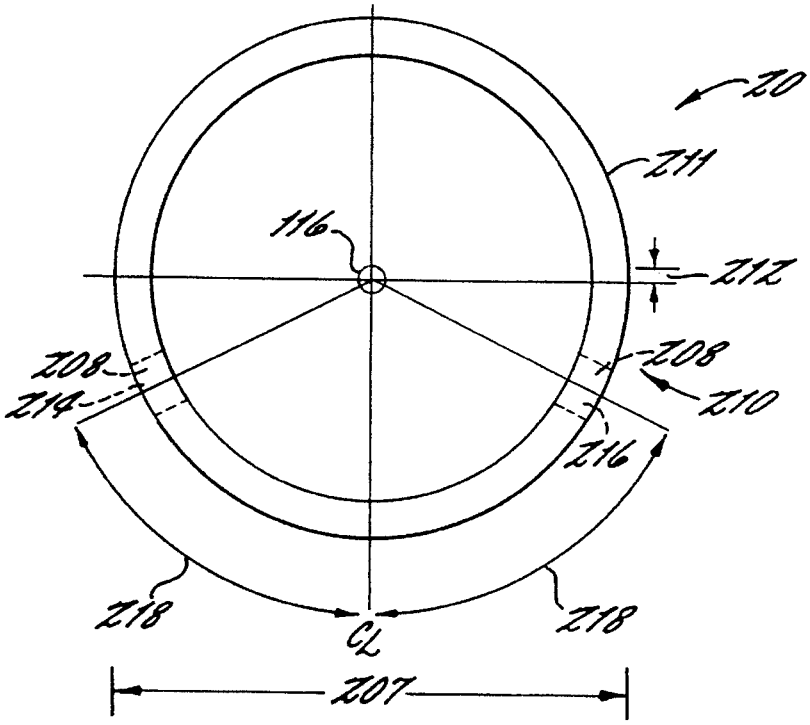
FIG. 3 is an end view of the distribution pipe.

FIGS. 2 and 3 illustrate a side and an end view, respectively, of distribution pipe 20. The side view in FIG. 2 depicts an inlet at a first end 202, a second end 204, a cylindrical axis 116, a wall 206, and a plurality of holes 208. In the embodiment shown, the second end 204 further comprises a generally cylindrical cap 205 dimensioned to closely engage second end 204 for preventing liquid effluent from escaping out second end 204 and for preventing soil from entering second end 204. Holes 208 are shown disposed along the bottom half 210 of distribution pipe 20, which is defined by the area of pipe 20 below an imaginary plane 212 longitudinally bisecting distribution pipe 20 along cylindrical axis 116, as is shown in FIG. 3. Top half 211 is likewise defined by the area of pipe 20 above the imaginary plane 212.

Holes 208 in a preferred embodiment are disposed in two generally straight, generally parallel lines 214 and 216, the lines being generally parallel to the cylindrical axis 116. In FIG. 3, it is shown that these lines 214 and 216 of holes 208 are spaced at an angle 218 of approximately 120 degrees from each other. It can be seen that flow line 219, which is parallel to the cylindrical axis 116 and runs beneath the lines of holes 214 and 216, defines the volume of liquid effluent that can be retained in distribution pipe 20.

Figure 5:
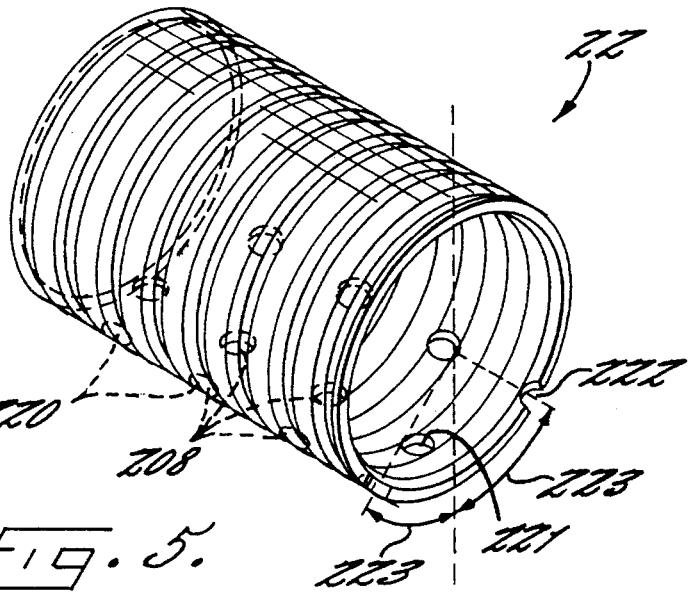
FIG. 5 illustrates an alternate embodiment of the distribution pipe having three rows of holes.
Figure 6A:
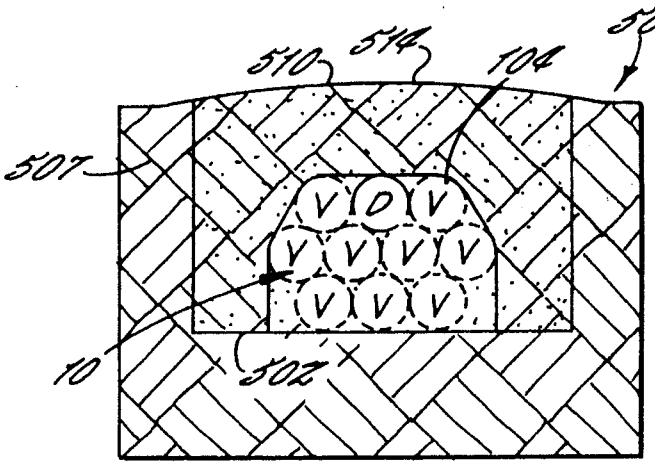
FIG. 6 (*a*)–(*d*) illustrate end views of four embodiments of the present invention.
Figure 6B:
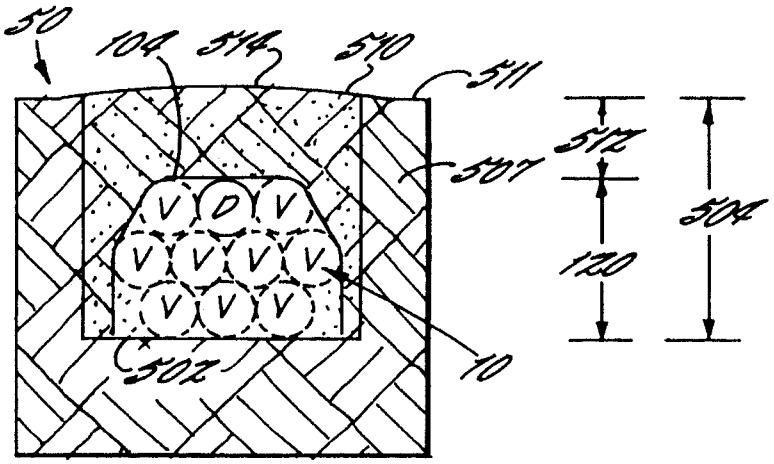
Figure 6C:
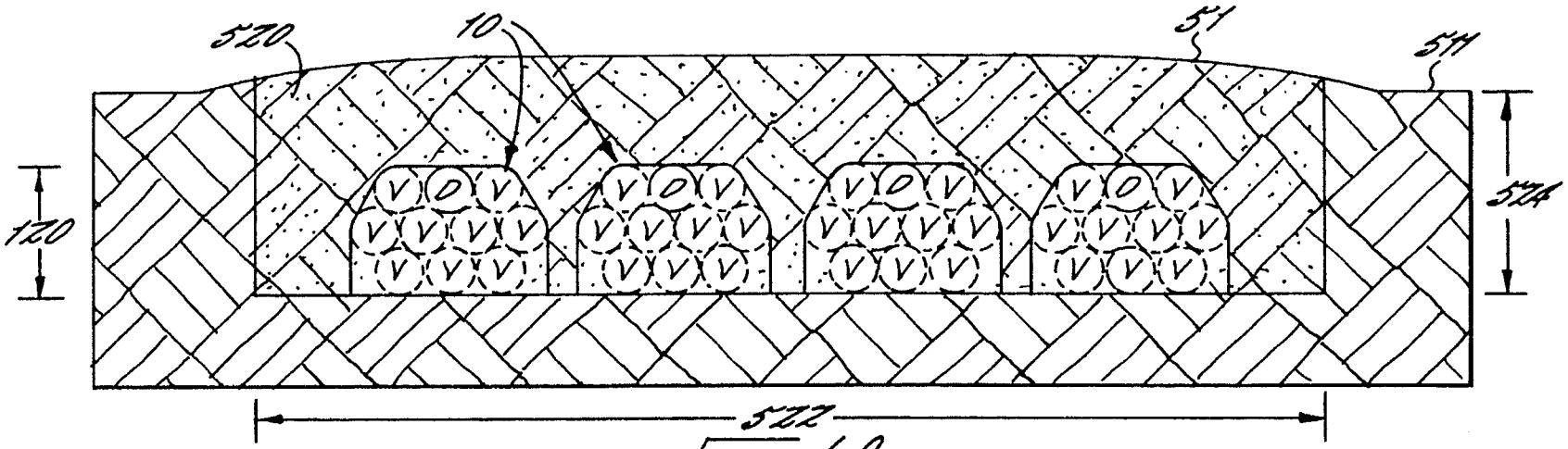
Figure 6D:
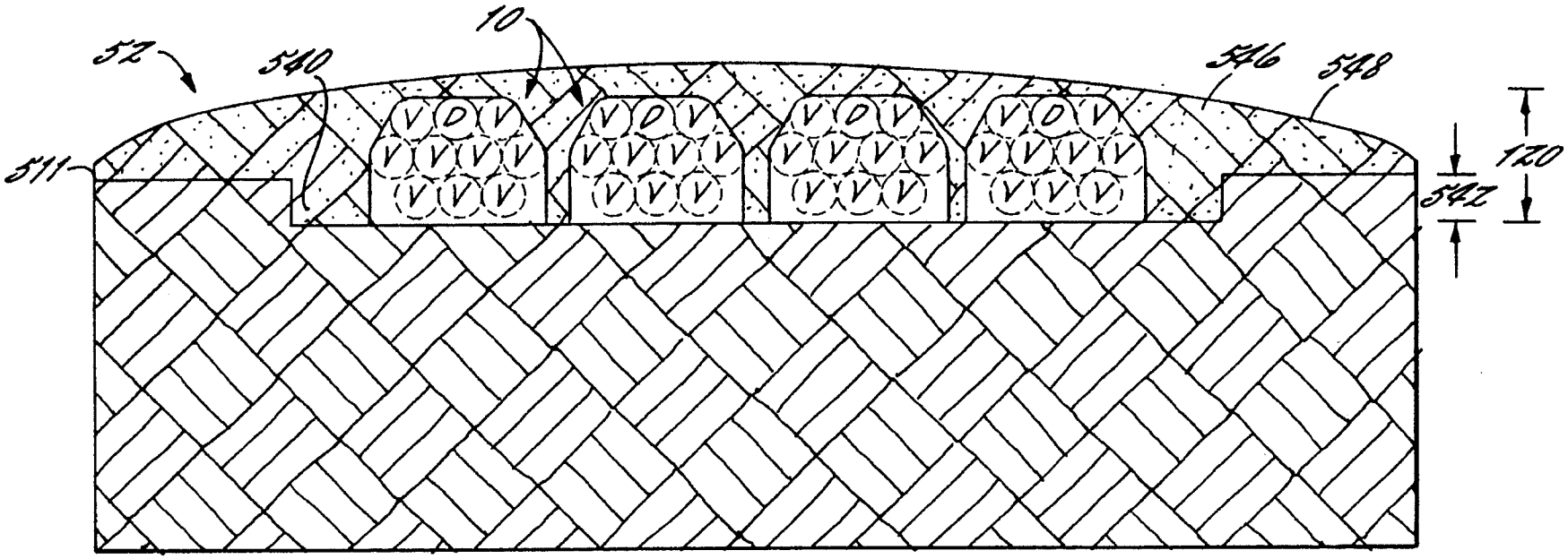

In an alternate embodiment of distribution pipe 22, shown in FIG. 5, holes 208 are distributed in three generally parallel, generally straight lines 220, 221, and 222 distributed so that lines 220 and 222 each make an angle 223 of 45 degrees with a diametric line 224 that passes through the middle line of holes 221. Middle line of holes 221 is disposed generally at the lowest point of pipe 22 when positioned in an assembly in a trench, that is, with middle line 221 along the diametric line 224 positioned perpendicular to level ground.

Figure 7:
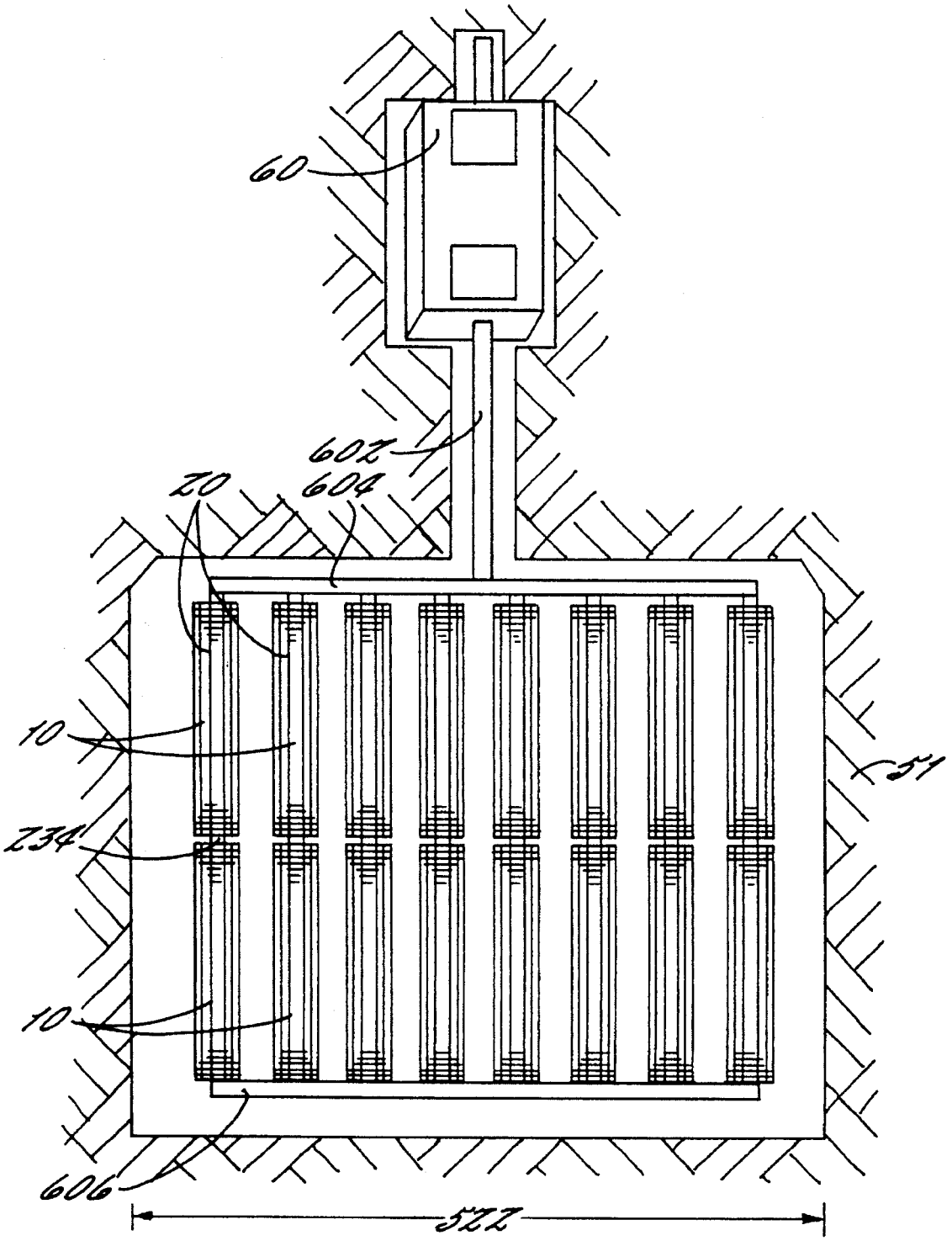
FIG. 7 is a plan view of a leach bed system having a plurality of parallel pipe assemblies.
Figure 8:
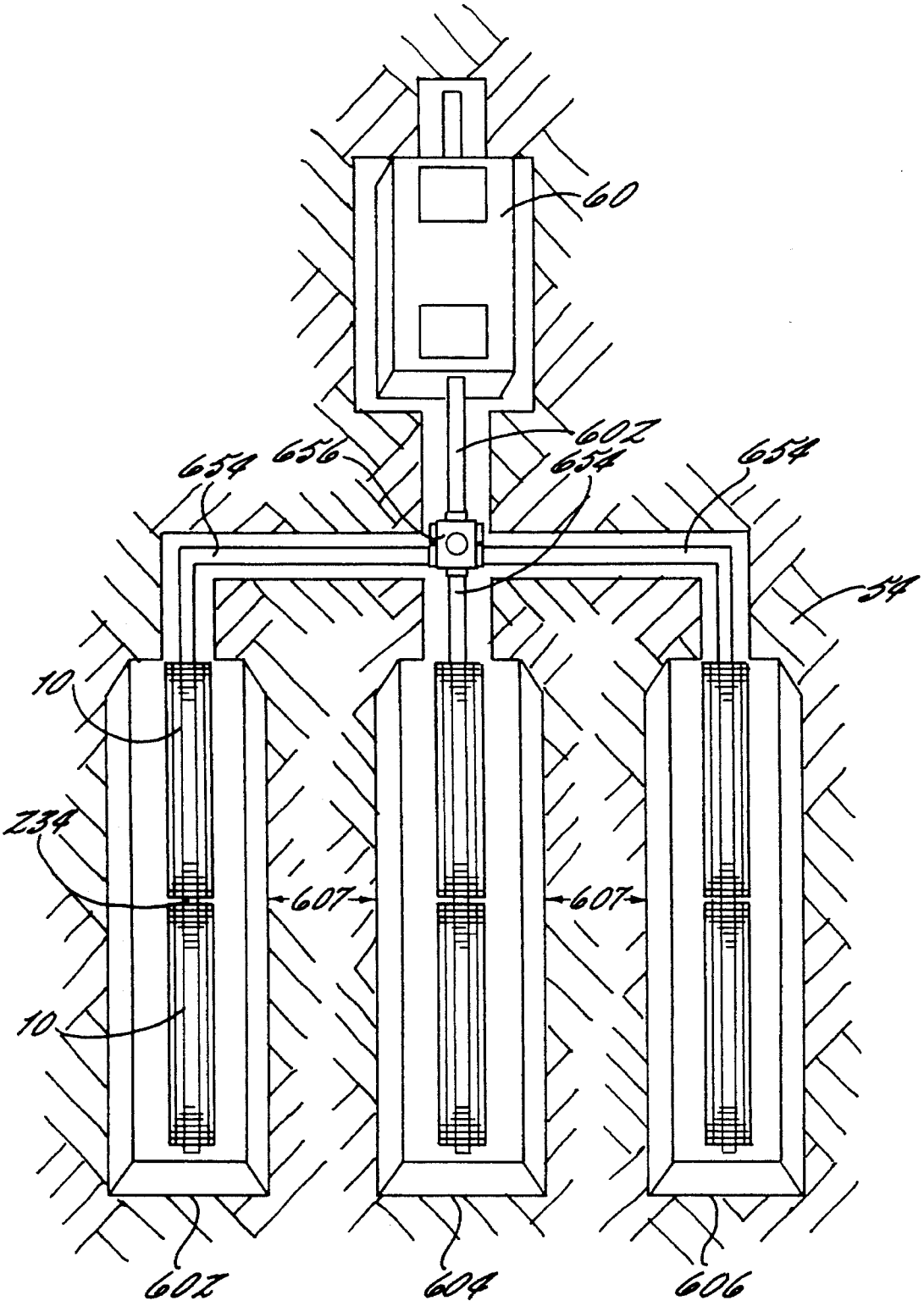
FIG. 8 is a plan view of an alternate embodiment of a trench system having a plurality of trenches with two pipe assemblies connected in series in each trench.

Returning to the embodiment of FIGS. 2 and 3, distribution pipe 20 further comprises a coupler 234 for connecting the distribution pipe to another distribution pipe or to a connecting pipe (see FIGS. 7 and 8). Coupler 234 in the preferred embodiment takes the form of a tube having an inner diameter larger than the outer diameter of distribution pipe 20, the respective diameters being sufficiently close to enable a distribution pipe 20 to make a liquid-impervious fit when inserted into an end of coupler 234. In order to couple two distribution pipes 20 together, coupler 234 on one end of a first distribution pipe 20 is then fitted over a second end of a second distribution pipe 20.

In addition, a marking such as reference stripe 236 is disposed on the top half 211 midway between the lines 214 and 216 of holes 208. Stripe 236 permits the accurate positioning of distribution pipe 20 so that the lines 214 and 216 of holes 208 define equal angles 218 with level ground to maximize liquid effluent distribution.

Each void pipe 30 is a generally cylindrical pipe that has a cylindrical axis 117, a wall 302, and a plurality of holes 304 through the wall 302. In a preferred embodiment, the holes 304 in void pipes 30 are disposed in a plurality of generally straight, generally parallel lines, five of which are shown in side view in FIG. 4 as 306, 307, 308, 309, and 310. Lines 306—310 are generally parallel to the cylindrical axis 117. Generally there are at least six lines of holes, with an eight-line embodiment shown in FIG. 4.

Figure 4:
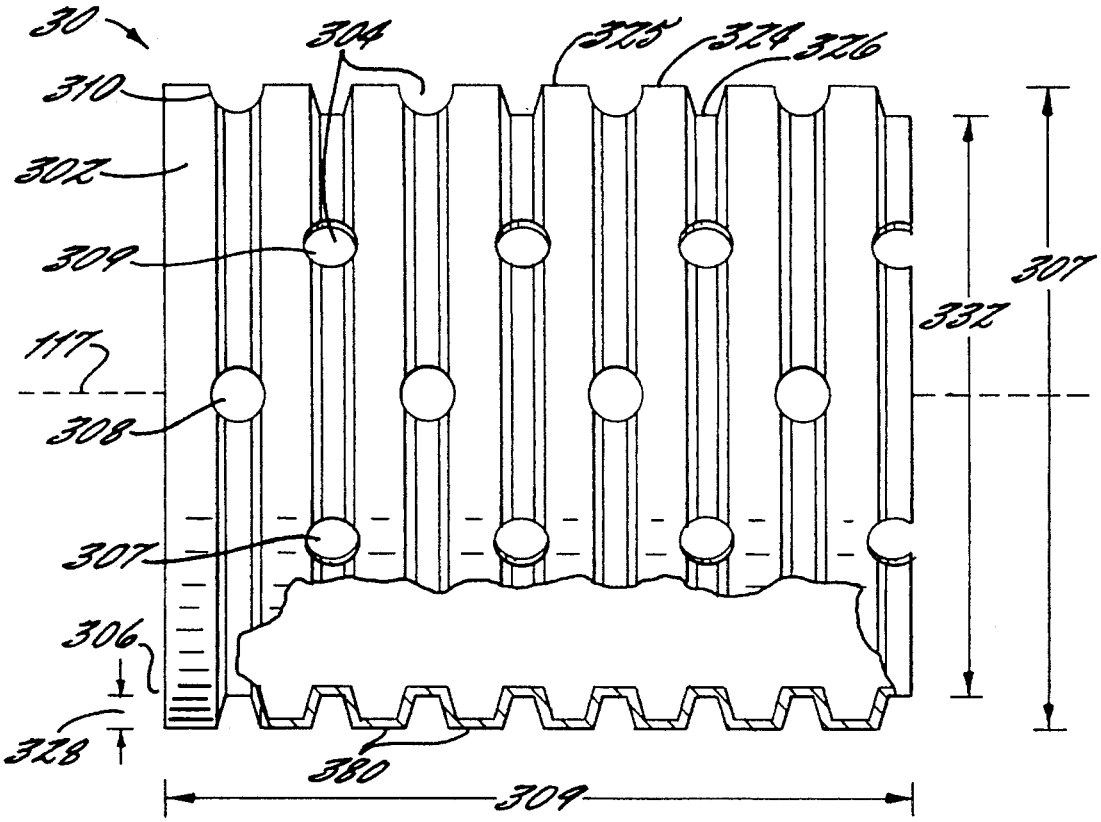
FIG. 4 is a side view of a void pipe.

As is shown in FIGS. 2 and 4, distribution pipe 20 and void pipes 30 comprise corrugated pipes, in one embodiment having diameters 207 and 307, respectively, of 4 inches and a lengths 209 and 309, respectively, of 10 feet. The corrugations 225 in distribution pipe 20 are defined by regions of larger diameter 224 and smaller diameter 226. The regions of larger diameter 224 define a valley 227 having a depth 228 defined by the difference between the larger diameter 207 and the smaller diameter 232. The corrugations 325 in void pipe 30 are defined by regions of larger diameter 324 and smaller diameter 326. The regions of larger diameter 324 define a valley 327 having a depth 328 defined by the difference between the larger diameter 330 and the smaller diameter 332. In the embodiment of the void pipe 30 shown in FIG. 4, holes 304 are distributed in regions of smaller diameter 326 such that each line comprises holes in alternating regions of smaller diameter 326. Each adjacent line has a series of holes staggered in a direction parallel to cylindrical axis 117 by one region of smaller diameter 326.

It can be seen that the flow, distribution, and retention properties of drain field assembly 10 can be altered in several ways and thus can be tailored to specific sites, applications, and volume demands. For instance, fluid retention time is a function of depths 228 and 328 of the valleys 226 and 326; the size, number, and placement of holes 208 and 304; and the lengths 209 and 309 and diameters 207 and 307 of pipes 20 and 30, respectively. In addition, one can alter the number of void pipes 30 in the assembly 10 to adjust the time it takes fluid to trickle from distribution pipe 20 through the plurality of void pipes 30 into the soil. The placement of holes 208 and 304 relative to the corrugations in pipes 20 and 30 can also be seen to affect retention time: If the holes 208 and 304 are placed in regions of smaller diameter 226 and 326, retention time is greater than if placed in regions of larger diameter 224 and 324. As an example, the darkened areas 380 at the bottom of FIG. 4 illustrate fluid retention volume in pipe 30.

Protective sheeting 102 comprises a soil-impervious, liquid-permeable fabric that is draped over the top 104 and the sides 106 and 108 of assembly 10. The soil-impervious nature of the sheeting 102 protects the holes 208 and 304 in pipes 20 and 30, respectively, from being clogged by surrounding soil. The liquid-permeable nature of the sheeting 102 permits improved liquid distribution properties because, as sheeting 102 is forced against holes 304 in void pipes 30, more contact area is created with the effluent being discharged.

In the preferred embodiment, protective sheeting 102 comprises a spun-bonded, nonwoven fabric. Such fabrics may include nylon or polyester. In the preferred embodiment a fabric known as Tile guard (Remay TM, Style 2005 or 2015, DuPont, Wilmington, Del.) is used.

In the preferred embodiment, returning to FIG. 1, the drain field assembly's adjacent rows comprise a top row 110 along the top of the assembly, a center row 112, and a bottom row 114 along the bottom of the assembly. Top row 110 comprises a distribution pipe 20 disposed between two void pipes 30. Distribution pipe 20 is positioned having its bottom half 210 facing the bottom 109 of the assembly. Center row 112 comprises four void pipes 30. Bottom row 114 comprises three void pipes. These three rows are disposed in a close-packed arrangement, wherein the cylindrical axes 116 or 117 of any three adjacent pipes define an equilateral triangle 382 in a plane 384 normal to the cylindrical axes 116 and 117. In the preferred embodiment, which employs 4-inch-diameter, 10-feet-long corrugated pipes, the assembly 10 has a width 118 of 18 inches and a height 120 of 15 inches.

The drain field of the present invention, shown in one embodiment without backfill in FIG. 1 and referred to generally by the reference number 50, comprises drain field assembly 10 as described above positioned with its bottom 109 facing downwards in a generally rectangular trench 502 having a depth 504 beneath ground level 510, a width 506, and a length 508. In a preferred embodiment for a single assembly 10, trench width 506 may be 24 or 36 inches. Depth 504 should be not less than 24 inches nor more than 30 inches. The width 118 and the length 119 of drain field assembly 10 are dimensioned to reside within trench 502. In order to maximize the uniformity of liquid effluent distribution, it is preferred to position assembly 10 so that cylindrical axes 116 and 117 are generally parallel to level ground. Trench 502 is surrounded by undisturbed earth 507.

Drain field 50 further comprises backfill material 510 sufficient to cover drain field assembly 10 (see FIG. 6). The amount of backfill cover 512 is the difference between the top 104 of assembly 10 and the top 514 of the drain field 50, which may or may not be even with level ground level 511. If the top 104 of assembly 10 is greater than the depth 504 of trench 502, assembly 10 and backfill material 510 form a mound. When constructed, cover 512 should include at least 2 inches of overfill to allow for settling.

Five embodiments of drain field 50 are illustrated in cross section in FIGS. 6(*a*)–(*d*) and in plan view in FIGS. 7 and 8. FIGS. 6(*a*) and (*b*) show 36- and 24-inch-wide trenches, respectively, each having a single assembly 10 placed within trench 502. In these embodiments, the height 120 of assembly 10 is less than the depth 504 of trench 502.

A bed system 51 is shown in FIG. 6(*c*), which is also shown in plan view in FIG. 7, comprises a trench 520 having a width 522 dimensioned to hold a plurality of drain field assemblies 10 disposed in generally parallel fashion side by side. In this embodiment as well, the height 120 of assembly 10 is less than the depth 524 of trench 520. As shown in FIG. 7, assemblies 10 receive liquid effluent in parallel from a sewage disposal system 60 via a header pipe 602 exiting from system 60, pipe 602 connected to a perpendicularly disposed connecting pipe 604, through which effluent is distributed into the distribution pipes 20 of each assembly 10 in parallel. It is further shown in FIG. 7 that additional distribution capacity may be obtained by connecting a plurality of assemblies 10 in series via couplers 234. Further equalization of distribution is accomplished via a secondary connecting pipe 606, which is connected to all of the second ends of distribution pipes 20.

FIG. 6(*d*) illustrates a typical mound system 52, wherein a plurality of assemblies 10 are placed generally in parallel in a trench 540 having a depth 542 wherein assemblies 10 reside. Depth 542 is less than the height 120 of assemblies 10, and, therefore, assemblies 10 protrude above level ground 511. Backfill material 546 covers assemblies 10 by forming a mound 548 above level ground 511.

A further drain field 54 is illustrated in FIG. 8, wherein a plurality of generally parallel trenches 602, 604, and 606, separated by a distance 607, contain a plurality of assemblies 10. Assemblies 10 receive liquid effluent from a sewage disposal system 60 via a header pipe 602 exiting from system 60, pipe 602 being connected to a plurality of connecting pipes 654 via a distribution box 656. It is further shown in FIG. 8 that additional distribution capacity may be obtained by connecting a plurality of assemblies 10 in series via couplers 234.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A drain field assembly having a top, a bottom, and two sides for use with a sewage disposal system, the assembly comprising:

a generally cylindrical distribution pipe for receiving liquid effluent from the sewage disposal system, the distribution pipe having an inlet at a first end, a second end, a central axis, a cylindrical cross section, a bottom half and a top half defined by an imaginary plane bisecting the distribution pipe along the central axis and through the cylindrical cross section, a wall, and a plurality of holes through the wall, the holes distributed along the bottom half;

a plurality of generally cylindrical void pipes for receiving effluent from the distribution pipe, retaining the effluent for a time, and distributing the effluent to an area of soil, each void pipe having a central axis, a wall, and a plurality of holes through the wall; and a protective soil-impervious, liquid-permeable sheeting covering the top and the two sides of the assembly for protecting the holes in the distribution pipe and the void pipes from intrusion by soil; wherein:

the distribution pipe is positioned along the top of the assembly with the bottom half facing the bottom of the assembly; and the distribution pipe and the void pipes are situated in a plurality of adjacent rows, the central axes of the distribution pipe and the void pipes generally parallel to each other and to the sides of the drain field assembly, with one row of void pipes along the bottom of the assembly.

2. The drain field assembly recited in claim 1, wherein the second end of the distribution pipe is capped for preventing liquid effluent from escaping out from the second end, and further for preventing soil from entering the second end.

3. The drain field assembly recited in claim 1, wherein the holes in the distribution pipe are disposed in two generally straight, generally parallel lines, the lines generally parallel to the central axis.

4. The drain field assembly recited in claim 3, wherein the two lines of holes are spaced at an angle of approximately 120 degrees from each other.

5. The drain field assembly recited in claim 3, wherein the distribution pipe further has:

a coupler for connecting the distribution pipe to another distribution pipe; and a marking disposed on the top half midway between the lines of holes for accurately positioning the distribution pipe so that the lines of holes define equal angles with level ground to maximize liquid effluent distribution.

6. The drain field assembly recited in claim 1, wherein the holes in the distribution pipe are disposed in three generally straight, generally parallel lines, the lines generally parallel to the central axis.

7. The drain field assembly recited in claim 1, wherein the holes in the void pipes are disposed in a plurality of generally straight, generally parallel lines, the lines generally parallel to the central axis.

8. The drain field assembly recited in claim 1, wherein the distribution pipe and the void pipes comprise corrugated pipes having alternating regions of larger diameter and smaller diameter, each region of larger diameter defining a valley having a depth defined by the difference between the larger diameter and the smaller diameter.

9. The drain field assembly recited in claim 8, wherein the holes in the distribution pipe are disposed in generally straight, generally parallel lines, the lines generally parallel to the central axis, the holes further disposed in regions of larger diameter.

10. The drain field assembly recited in claim 8, wherein the holes in the distribution pipe are disposed in generally straight, generally parallel lines, the lines generally parallel to the central axis, the holes further disposed in regions of smaller diameter.

11. The drain field assembly recited in claim 10, wherein:

the holes in the void pipes are disposed in a plurality of generally straight, generally parallel lines, the lines generally parallel to the central axis; and the plurality of lines comprises at least six lines, each line having a series of holes disposed in alternating regions of smaller diameter, each line adjacent another line having a series of holes staggered by one region of smaller diameter.

12. The drain field assembly recited in claim 1, wherein:

the plurality of adjacent rows comprises:

a top row along the top of the assembly, comprising the distribution pipe and two void pipes, one void pipe on either side of the distribution pipe; a center row of four void pipes; and a bottom row along the bottom of the assembly, comprising three void pipes; and the rows are disposed in a close-packed arrangement, the cylindrical axes of any three adjacent pipes defining an equilateral triangle in a plane normal to the central axes.

13. The drain field assembly recited in claim 1, wherein the protective sheeting comprises a spun-bonded, nonwoven fabric.

14. A drain field for use with a sewage disposal system comprising:

a generally rectangular trench having a depth beneath ground level, a width, and a length;

a drain field assembly having a top, a bottom, two sides, a width, and a height, the assembly positioned within the trench with the bottom facing downward and comprising:

a generally cylindrical distribution pipe for receiving liquid effluent from the sewage disposal system, the distribution pipe having an inlet at a first end, a capped second end for preventing liquid effluent from escaping out from the second end, a central axis, a cylindrical cross section, a bottom half defined by an imaginary plane bisecting the distribution pipe along the central axis and through the cylindrical cross section, a wall, and a plurality of holes through the wall, the holes distributed along the bottom half;

a plurality of generally cylindrical void pipes for receiving effluent from the distribution pipe, retaining the effluent for a time, and distributing the effluent to an area of soil, each void pipe having a central axis, a wall, and a plurality of holes through the wall;

a protective soil-impervious, liquid-permeable sheeting surrounding the top and the two sides of the assembly for protecting the holes in the distribution pipe and the void pipes from intrusion by soil; wherein:

the length and the width of the assembly are dimensioned to reside within the trench;

the distribution pipe is positioned along the top of the assembly with the bottom half facing the bottom of the assembly; and the distribution pipe and the void pipes are situated in a plurality of adjacent rows, the central axes of the distribution pipe and the void pipes generally parallel to each other and to the sides of the drain field assembly, with one row of void pipes along the bottom of the assembly; and backfill material sufficient to cover the drain field assembly.

15. The drain field recited in claim 14, wherein the height of the assembly is less than the depth of the trench.

16. The drain field recited in claim 14, wherein the drain field assembly comprises a plurality of drain field assemblies, disposed in generally parallel fashion side by side.

17. The drain field recited in claim 16, wherein the plurality of distribution pipes receive liquid effluent in series from the sewage disposal system.

18. The drain field recited in claim 16, wherein the plurality of distribution pipes receive liquid effluent in parallel from the sewage disposal system.

19. The drain field recited in claim 16, wherein the height of the assembly is less than the depth the trench.

20. The drain field recited in claim 16, wherein the height of the assembly is greater than the depth of the trench and the backfill material forms a mound.

21. The drain field recited in claim 14, wherein the drain assembly is positioned having the central axes of the distribution pipe and the void pipes generally parallel to level ground to maximize uniformity of liquid effluent distribution.

* * * * *